US005944557A

United States Patent [19]

Fukuda

[11] Patent Number: 5,944,557

[45] Date of Patent: Aug. 31, 1999

[54] ELECTRICAL CONNECTOR

[75] Inventor: Masaru Fukuda, Shizuoka, Japan

[73] Assignee: Yazaki Corporation, Tokyo, Japan

[21] Appl. No.: 08/928,648

[22] Filed: Sep. 12, 1997

[30] Foreign Application Priority Data

Sep. 12, 1996 [JP] Japan ..... 8-242097

[51] Int. Cl.[6] ..... H01R 13/40

[52] U.S. Cl. ..... 439/595

[58] Field of Search ..... 439/595, 746

[56] References Cited

U.S. PATENT DOCUMENTS 5,575,684 11/1996 Uchida et al. ..... 439/595

5,622,521 4/1997 Marceau et al. ..... 439/595

FOREIGN PATENT DOCUMENTS 4-92379 8/1992 Japan ..... H01R 13/42

*Primary Examiner*—Neil Abrams

*Assistant Examiner*—T C Patel

*Attorney, Agent, or Firm*—Sughrue, Mion, Zinn, Macpeak & Seas, PLLC

[57] ABSTRACT

An electrical connector including a connector housing for receiving a terminal in a terminal accommodating chamber. The connector housing includes a flexible locking piece which locks the terminal in the connector housing and which deflects into a deflection space when the terminal is inserted into the connector housing. A spacer is inserted into the deflection space of the connector housing to maintain the engagement of the terminal and the flexible locking piece. An inflated portion is formed in the connector housing adjacent to the base of the flexible locking piece to reduce the deflection space of the flexible locking piece, thereby preventing buckling of the flexible locking piece.

8 Claims, 3 Drawing Sheets

ELECTRICAL CONNECTOR

BACKGROUND OF THE INVENTION

1. Field of the Invention

This invention relates to a connector which is suitably applied to vehicles such as automobiles.

2. Description of the Related Art

A connector in a vehicle such as an automobile is so designed that it will not readily come off its housing even when shock during traveling.

For instance, as disclosed in Japanese Utility Model Publication No. Hei. 4-92379, in order to prevent the terminal from coming off the terminal housing even when the wire is pulled, two preventing means are provided between the terminal and the connector housing; that is, the terminal is positively locked to the connector housing.

This will be described with reference to FIGS. 4 and 5. Inside the connector housing 51, a terminal accommodating chamber 52 is provided which is surrounded by an inner wall 58, and a flexible locking piece 55 (hereinafter referred to as "a lance 55", when applicable) is protruded from the inner wall 58. The lance 55 is engaged with a terminal 53 inserted into the terminal accommodating chamber 52, thereby to prevent the terminal 53 from coming off the terminal accommodating chamber 52. The terminal accommodating chamber 52 includes a deflection space 57 for allowing deflection of the lance 55.

In addition, the connector has a spacer 59 which is inserted into the deflection space 57 to prevent the unwanted deflection of the aforementioned lance 55.

That is, after the lance 55 is elastically deflected in association with the movement of the terminal 53 which is inserted into the terminal accommodating chamber 51, it is placed in steady state with the terminal completely inserted thereinto, thus being engaging with the terminal 53. Hence, the terminal 53 is set at a predetermined position, and the deflection space 57 is placed in open state. Hence, as shown in FIG. 4, a spacer 59 is inserted to close the deflection space 57. As a result, the spacer 59 prevents the deflection of the lance 55. That is, the terminal 53 is double-locked. Hence, even if the wire 54 is pulled, the terminal is prevented from being removed backwardly from the connector housing.

Before the terminal 53 abuts against the front end face 63 of the connector housing; that is, in the case where the terminal 53 is incompletely inserted thereinto, the lance 55 is elastically deflected, and therefore the spacer 59, striking against the lance 55, cannot be inserted in the deflection space 57. Therefore, the spacer 59 has a function of detecting whether or not the terminal has been completely inserted thereinto.

In the above-described connector, the terminal is double locked, so that the terminal 53 is completely prevented from coming off the terminal accommodating chamber. However, if, under the condition that the terminal 53 is incompletely inserted thereinto, and the lance 55 is elastically deflected, the operator forcibly pushes the spacer 59, then the lance is contracted (or buckled), so that the spacer can be pushed in the connector housing 51. Hence, the connector may be shipped out with the terminal 53 incompletely inserted thereinto.

SUMMARY OF THE INVENTION

In view of the foregoing, an object of the invention is to provide a connector in which, even if the worker forcibly pushes the spacer when the terminal is not completely inserted thereinto yet, the lance will never be bent, and furthermore it can be detected whether or not the terminal is completely inserted thereinto.

According to the present invention, there is provided a connector comprising: a connector housing having a terminal accommodating chamber and a flexible locking piece being protruded from an inner wall of the terminal accommodating chamber, a terminal being inserted into the terminal accommodating chamber so as to be engaged with the flexible locking piece prevent the terminal from coming off the connector housing; and a spacer to inserted in a deflection space provided for the flexible locking piece in the connector housing to regulate an elastic deflection of the flexible locking piece thereby to maintain an engagement of the terminal with the flexible locking piece; wherein an inflated portion to reduce the deflection space is provided in a part of the inner wall of the connector housing which corresponds to a base of the flexible locking piece so as not to affect the elastic deflection of the flexible locking piece.

If the insertion of the terminal is insufficient, the lance is deflected into the deflection space. If, under this condition, the spacer is strongly pushed in the direction of insertion, the bending of the lance is prevented by the inflated portion, and therefore the spacer cannot be inserted thereinto.

DETAILED DESCRIPTION OF THE PREFERRED EMBODIMENTS

Figure 1:
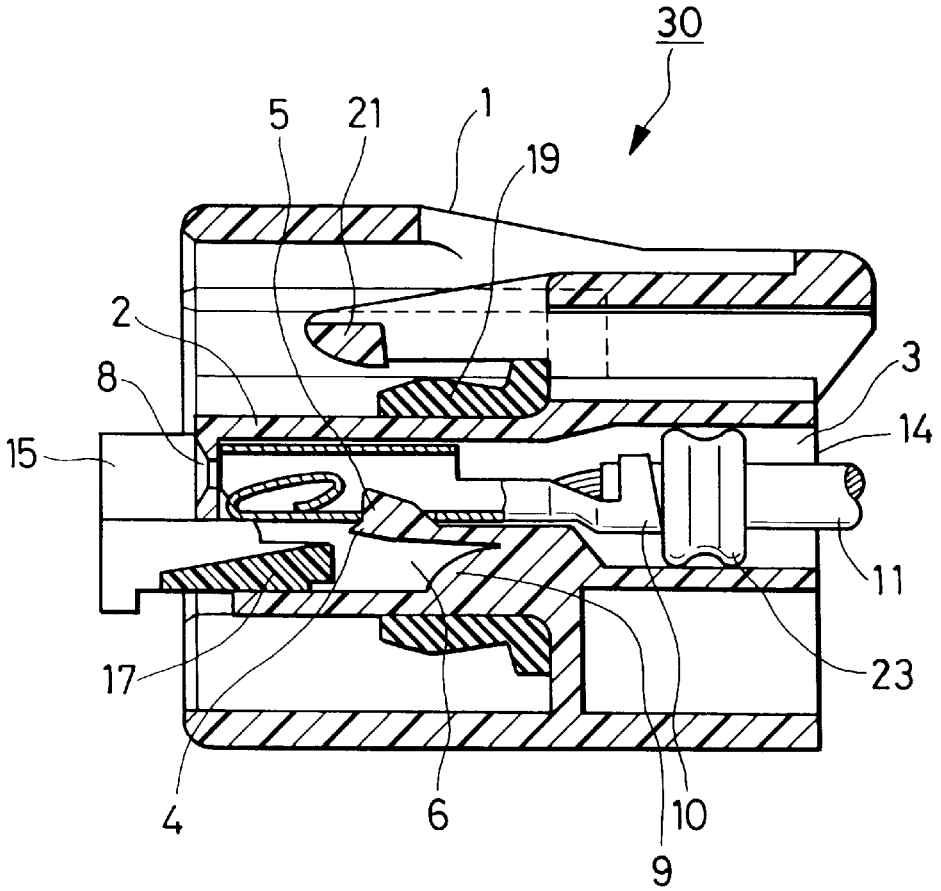
FIG. 1 is a longitudinal sectional view showing a connector according to the invention in which a spacer is temporarily locked.
Figure 2:
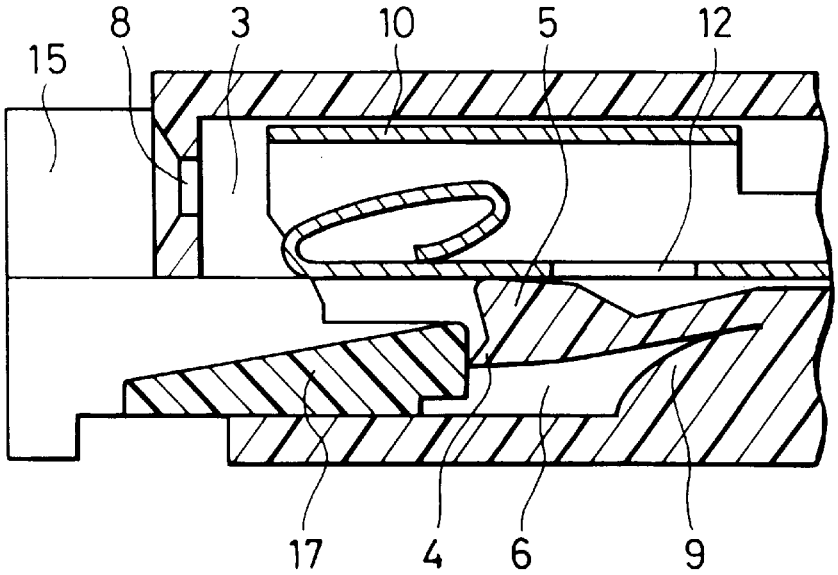
FIG. 2 is a longitudinal sectional view showing essential components of the connector shown in FIG. 1.
Figure 3:
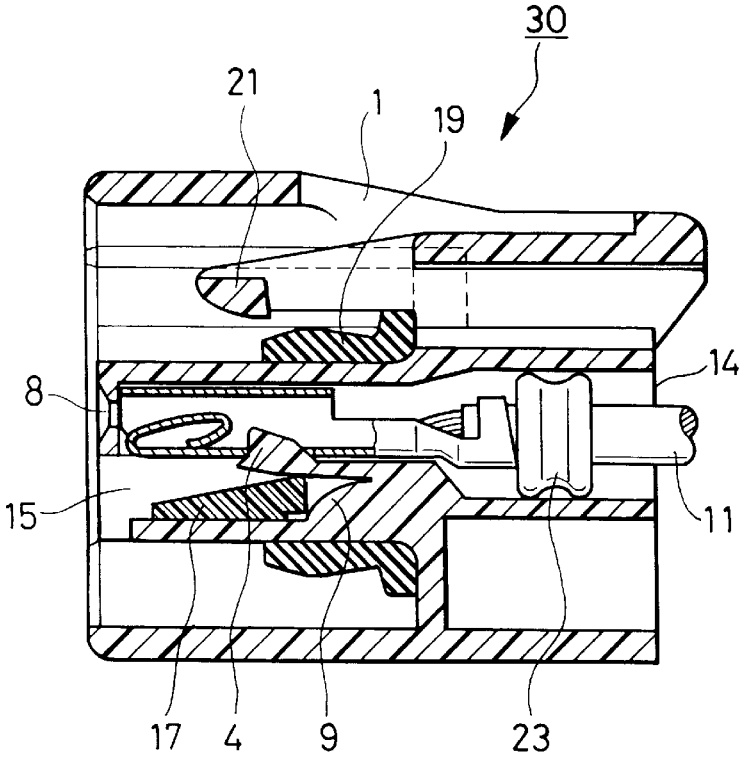
FIG. 3 is a longitudinal sectional view showing the connector of the invention in which the spacer is completely locked.
Figure 4:
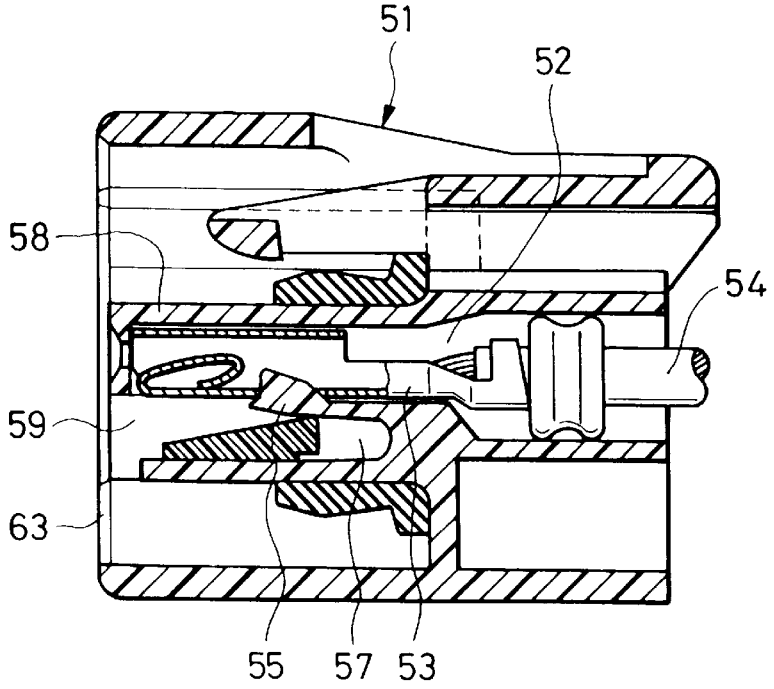
FIG. 4 RELATED ART
FIG. 4 is a sectional view of a conventional connector.
Figure 5:
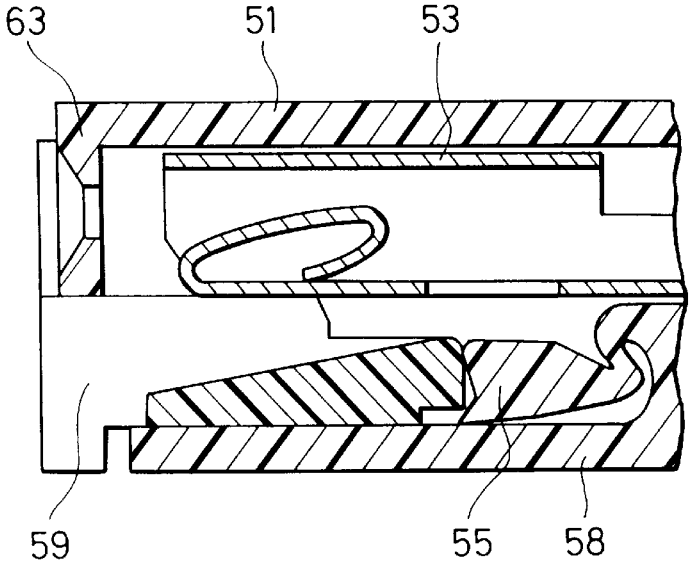
FIG. 5 RELATED ART
FIG. 5 is a sectional view showing a flexible locking piece in the conventional connector shown in FIG. 4.

A connector, which constitutes a preferred embodiment of the invention, will be described with reference to the accompanying drawings. FIG. 1 is a longitudinal sectional view of the connector of the invention in which a spacer is temporarily locked. FIG. 2 is a sectional view showing essential components of the connector shown in FIG. 1. FIG. 3 is a longitudinal sectional view showing the connector of the invention which has been assembled with the spacer completely locked. The embodiment is a male connector engaged with a female connector.

The connector 30 of the invention comprises: a connector housing 1 which is formed by molding resin, and is substantially in the form of a box. Substantially in the center of the connector housing 1, a substantially cylindrical terminal accommodating chamber 3 is formed which is surrounded by an inner wall 2.

The terminal accommodating chamber 3 has a flexible locking piece 4 (hereinafter referred to as "a lance 4", when applicable) which engages with a terminal 10 which is inserted into the connector housing 1 from behind, to prevent the terminal 3 from coming off the terminal accommodating chamber 3. That is, the lance 4 is extended forwardly from a part of the inner wall 2 of the terminal accommodating chamber 3, and it is elastically swingable with its end (as viewed in the direction of insertion of the terminal) as a free end. The lance 4, abutting against the terminal 10 inserted into the terminal accommodating chamber 3, is elastically deflected (swung), and then placed in steady state. The lance 4 has a locking protrusion 5 which is engaged with a locking hole 12 of the terminal 10. In order to elastically deflect (swing) the lance 4 as the terminal 10 is inserted into the terminal accommodating chamber, a deflection space 6 which receives the deflection of the lance 4 is provided between the inner wall 2 and the lower surface of the lance 4.

A specific feature of the embodiment resides in that an inflated portion 9 which may reduce the deflection space 6 in such a manner that, when the lance 4 is elastically deflected, the elastic deflection of the lance 4 may not be affected thereby, is provided at the part of the inner wall 2 which corresponds to the base of the lance 4. That is, since the inflated portion reduces the deflection space 6, the buckling space is eliminated, and therefore the lance is not caused to buckle. Hence, as shown in FIG. 2, when the terminal 10 is incompletely inserted into the terminal accommodating chamber, the lance 4 is elastically deflected. However, even if, in this case, a spacer 15 (described later) is pushed in the direction of insertion and abutted against the lance 4, the 4 will not buckle, and therefore the spacer 15 will not go in the connector housing 1. Therefore, whether or not the terminal 10 has been completely inserted into the terminal accommodating chamber can be reliably detected.

The spacer 15 is substantially equal in structure to a conventional one. That is, the spacer 15 includes a tapered portion 17 which is inserted into the terminal accommodating chamber 3 through the front end face of the connector housing 1 and into the deflection chamber 6 to abut against the lower surface of the lance 4 to regulate the elastic deflection of the lance 4. The spacer 15 is slidably placed selectively in two states—a temporarily locked state, and a completely locked state. In the temporarily locked state, as shown in FIG. 1, the spacer 15 is attached to the connector housing 1; however, the tapered portion 17 is spaced away from the lance 4. In the completely locked state, the tapered portion 17, as shown in FIG. 3 is located under the lance 4.

The other structure is equal to that of the conventional art. That is, the connector housing 1 has a lock arm 21 on the outer surface which is engaged with the mating connector housing (not shown), and a water-proof packing 19 is put on the terminal accommodating chamber 3. A water-proof plug 19 is mounted on an electric wire 11 which is connected to the terminal 10, and the plug 19 is inserted tight in the terminal accommodating chamber. The terminal accommodating chamber 3 has an opening in the front end face into which the mating terminal (not shown) is inserted. The connector housing 1 has a terminal inserting inlet 14 in the rear end face.

The function of the above-described connector will be described.

The spacer 15 is inserted into the connector housing 1, and it is temporarily locked. Thereafter, the terminal 10 connected to the electric wire 11 is inserted into the terminal accommodating chamber 3 through the inserting inlet 14 of the connector housing 1. When, in this operation, one side surface of the terminal 10 abuts against the lance 4, the terminal inserting force elastically deflects the lance 4 towards the deflection space 6. When the terminal 10 is further inserted to the opening 8, the locking hole 12 of the terminal 10 reaches the locking protrusion 5 of the lance 4, so that the locking protrusion 5 is fixedly engaged with the locking hole 12; that is, the engagement of the terminal has been accomplished.

Next, when the spacer 15 is inserted into the deflection space 6, and is completely accommodated in the connector housing 1, the tapered portion 17 of the spacer 15 is positioned under the lance 4 to prevent the elastic deflection of the latter 4. Thus, the connector housing has been correctly assembled.

If, with the terminal 10 insufficiently inserted, the spacer 15 is pushed into the terminal accommodating chamber, the spacer 15 cannot be inserted fully because it abuts against the lance 4, as shown in the FIG. 2. And since the deflection space 6 is reduced by the inflated portion 9, the lance 4, unlike the conventional one, will not buckle, which positively prevents the insertion of the spacer 15.

As is apparent from the above description, the provision of the inflated portion 9 prevents the bending of the lance 4 which attributes to an erroneous operation.

Figure 6:
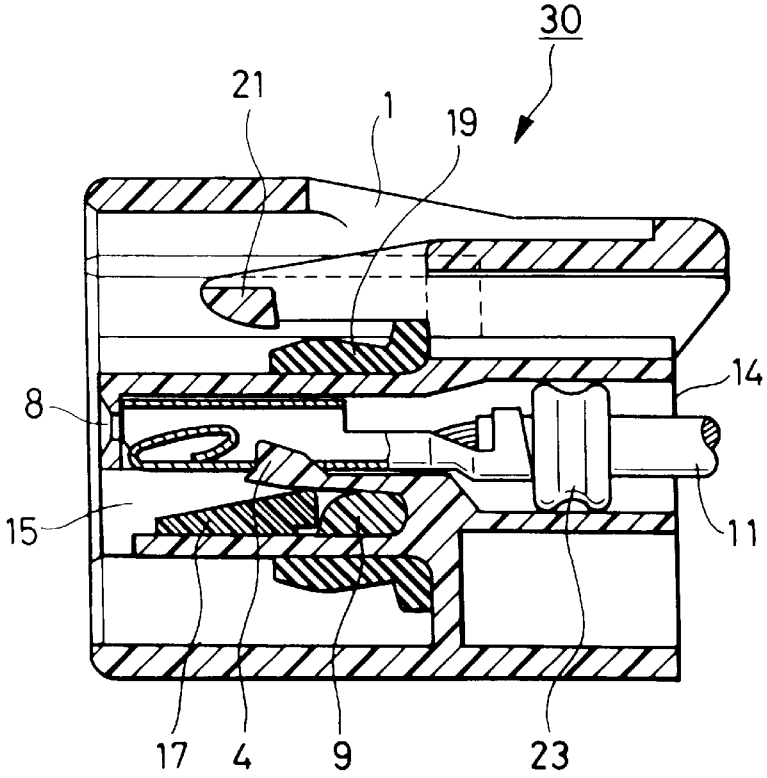
FIG. 6 is a longitudinal sectional view showing a modification of the connector in FIGS. 1 to 3 in which the spacer is completely locked.

In the above-described embodiment, the inflated portion 9 is integral with the inner wall 2. However, the embodiment may be so modified that the inflated portion 9 is separate from the inner wall 2 as shown in FIG. 6. In the above-described embodiment, the terminal 10 is of female type; however, it may be of a male type.

As was described above, with the connector of the invention, the inflated portion, which is formed in the part of the deflection space which corresponds to the base of the lance, prevents the bending of the lance. Hence, if, under the condition that, because of the insufficient insertion of the terminal, the lance is bent in the deflection space, the worker tries to strongly push the spacer into the deflection space, the spacer cannot be inserted thereinto. Therefore, it can be positively detected whether or not the terminal is correctly inserted.

What is claimed is:

1. A connector comprising:

a connector housing having a terminal accommodating chamber and a flexible locking piece being protruded from an inner wall of the terminal accommodating chamber, a terminal being inserted into said terminal accommodating chamber so as to be engaged with said flexible locking piece to prevent the terminal from coming off said connector housing; and a spacer to be inserted in a deflection space provided for said flexible locking piece in said connector housing to regulate an elastic deflection of said flexible locking piece thereby to maintain an engagement of said terminal with said flexible locking piece; and an inflated portion which reduces the deflection space, said inflated portion being disposed in said connector housing and adjacent to a base of said flexible locking piece so as to affect the elastic deflection of to prevent buckling of said flexible locking piece.

an inflated portion to reduce the deflection space is provided in a part of the inner wall of said connector housing which is adjacent to a base of said flexible locking piece so as to prevent buckling og said flexible locking piece.

2. The connector according to claim 1, wherein said inflated portion is integrally formed with said inner wall of said connector housing.

3. The connector according to claim 1, wherein said inflated portion is formed to be separate from said inner wall of said connector housing.

4. A terminal accommodating and retaining structure in a connector housing, comprising:

terminal accommodating chamber surrounded by an inner wall of the connector housing, a terminal being inserted into said terminal accommodating chamber;

a flexible locking piece protruding from the inner wall, and engageable with the inserted terminal so as to prevent the terminal form coming off said terminal accommodating chamber; and means for reducing a deflection space into which said flexible locking piece is deflected when said terminal is inserted into the terminal accommodating chamber and for preventing said flexible locking piece from buckling.

5. The terminal accomodating and retaining structure according to claim 4 wherein said reducing means is provided adjacent to a base of said flexible locking piece.

6. The terminal accomodating and retaining structure according to claim 5, wherein said reducing means is integrally formed with the inner wall of the connector housing.

7. The terminal accomodating and retaining structure according to claim 5, wherein said reducing means is formed to be separate from the inner wall of the connector .

8. The terminal accommodating and retaining structure according to claim 1, wherein said inflated portion is provided in a part of the inner wall of said connector housing.

* * * * *